US006578365B2

(12) United States Patent
Sicherman

(10) Patent No.: US 6,578,365 B2
(45) **Date of Patent: *Jun. 17, 2003**

(54) METHOD AND SYSTEM FOR SUPPLYING VAPORIZED GAS ON CONSUMER DEMAND

(75) Inventor: Gadi Sicherman, Hoshaya (IL)

(73) Assignee: ExTAExclusive Thermodynamic Applications Ltd, Jerusalem (IL)

( * ) Notice: Subject to any disclaimer, the term of this patent is extended or adjusted under 35 U.S.C. 154(b) by 0 days.

This patent is subject to a terminal disclaimer.

(21) Appl. No.: 10/108,450

(22) Filed: Mar. 29, 2002

(65) Prior Publication Data

US 2002/0112487 A1 Aug. 22, 2002

Related U.S. Application Data

(63) Continuation-in-part of application No. 09/674,700, filed on Nov. 6, 2000, now Pat. No. 6,470,690.

(51) Int. Cl.[7] ..... F17C 7/04; F17C 13/02
(52) U.S. Cl. ..... 62/48.1; 62/49.1
(58) Field of Search ..... 62/48.1, 49.1, 62/50.2, 50.3

(56) References Cited

U.S. PATENT DOCUMENTS 3,712,073 A * 1/1973 Arenson ..... 62/50.2
4,170,115 A * 10/1979 Ooka et al. ..... 62/50.2
4,224,802 A * 9/1980 Ooka ..... 62/50.2
4,331,129 A * 5/1982 Hong et al. ..... 126/611
4,464,904 A * 8/1984 Steigman ..... 62/50.2
4,718,481 A * 1/1988 Delatte ..... 165/108
4,745,760 A * 5/1988 Porter ..... 62/50.2
5,107,906 A * 4/1992 Swenson et al. ..... 141/11
5,505,232 A * 4/1996 Barclay ..... 141/11
6,470,690 B1 * 10/2002 Sicherman ..... 62/48.1

* cited by examiner

*Primary Examiner*—William C. Doerrler
(74) *Attorney, Agent, or Firm*—Mark M. Friedman

(57) ABSTRACT

A method and a system for supplying pressurized gas from a liquefied-gas (LG) storage tank, the method including the steps of: (a) providing a system including: (i) a storage tank for storing liquefied gas, the tank having a lower liquid region and a vapor region thereover; (ii) a heat exchanger external to the storage tank; (iii) pumping means driven by a liquid; (iv) a line for directly transferring the vaporized gas from the heat exchanger to the consumer; (b) pumping at least a portion of the liquefied gas from the lower region to the heat exchanger using the pumping means; (c) heating the liquefied gas in the heat exchanger to produce the vaporized gas; and (d) supplying the vaporized gas directly to the consumer, according to consumer demand.

28 Claims, 2 Drawing Sheets

(FROM PARENT APPLICATION)

METHOD AND SYSTEM FOR SUPPLYING VAPORIZED GAS ON CONSUMER DEMAND

This is a continuation-in-part (CIP) of U.S. patent application Ser. No. 09/674,700, filed Nov. 6, 2000 now U.S. Pat. No. 6,470,690.

FIELD AND BACKGROUND OF THE INVENTION

The present invention relates to a method and a system for supplying pressurized gas from a liquefied-gas (LG) storage tank.

LG systems are widely used in residential, agricultural, and industrial settings and they are expected to be a reliable source of energy, to operate safely, continuously, and to constantly supply guaranteed output. One critical performance criterion of LG systems is the delivery of a constant, stable and reliable flow of vaporized gas to the burners.

Some commonly used systems and methods of vaporization employ over-capacity storage tanks and vaporizers. The over-capacity storage tanks are expensive and provide inconsistent vapor pressure, especially during extreme ambient conditions. They also waste space, call for surplus gas stock and unnecessarily large and expensive storage area.

In one known system, the heat of vaporization is supplied by convection with respect to the ambient heat. However, this requires large heat-convection surfaces, according to the demand for the vaporized gas. Moreover, such systems are incapable of delivering gas at pressures exceeding that of the tank pressure.

In another known system, an external vaporizer is used to heat and vaporize the liquefied gas, with the vaporized gas being recirculated to the storage tank. The vaporized gas supplied to the consumer is delivered via a separate line connected to the storage tank, according to consumer demand. The recirculation of vaporized gas requires a large installation, and correspondingly high investment cost and maintenance expenses. Alternatively, the vaporized gas can be delivered directly to the consumer. However, various mechanical and control-related failures, as well as reduced consumer demand, can cause liquid-phase liquefied gas to be introduced to or to be condensed in the consumer delivery line. Liquid-phase liquefied gas in the vaporized gas is a major problem for many consumers. Consequently, such a process scheme generally requires the addition of vapor/liquid separation equipment for providing the consumer with solely vaporized gas. This equipment increases system complexity, size and cost, and introduces additional reliability and safety problems.

In my pending U.S. patent application Ser. No. 09/674,700, which is hereby incorporated for all purposes as if fully set forth herein, a system and method are disclosed in which the liquefied gas is circulated through an external heat exchanger and returned to the storage tank as a heated liquid. The sensible heat of the heated liquefied gas provides all of the requisite heat for vaporizing the gas (or at least a substantial portion thereof), which occurs within the storage tank. The vaporized gas is delivered via a separate vapor line connected to the storage tank, according to consumer demand.

The above-described system has numerous advantages with respect to other known systems. However, the storage tank operates under equilibrium or near-equilibrium conditions, such that the vapor produced is substantially saturated vapor. Consequently, any cooling that occurs in the supply line results in condensation of a portion of the vaporized gas. The system is not particularly suitable for high-pressure applications, because the entire system, including the storage tank and lines, must be pressurized according to the demand pressure. This means that the entire system operates under high pressure, a safety issue that preferably should be avoided.

There is therefore a recognized need for, and it would be highly advantageous to have a method and a system for supplying vaporized gas on consumer demand by producing superheated gas, thereby guaranteeing a reliable flow in any weather conditions and allowing for an improved fire safety than in systems known heretofore. It would be of further advantage if such a system would be simple and energy-efficient.

SUMMARY OF THE INVENTION

The present invention is a method and a system for supplying pressurized gas from a liquefied-gas (LG) storage tank. According to one aspect of the invention, the method includes the steps of: (a) providing a system including: (i) a storage tank for storing liquefied gas, the tank having a lower liquid region and a vapor region thereover; (ii) a heat exchanger external to the storage tank; (iii) pumping means driven by a liquid; and (iv) a line for directly transferring the vaporized gas from the heat exchanger to the consumer; (b) pumping at least a portion of the liquefied gas from the lower region to the heat exchanger using the pumping means; (c) heating the liquefied gas in the heat exchanger to produce the vaporized gas; and (d) supplying the vaporized gas directly to the consumer, according to consumer demand.

According to another aspect of the present invention there is provided a system for supplying vaporized gas to a consumer, including: (a) a storage tank for storing liquefied gas, the tank having a lower liquid region and a vapor region thereover; (b) a heat exchanger external to and fluidly communicating with the storage tank, within which heat exchanger, a heat exchange liquid and the liquefied gas come into indirect heat-exchange relation; (c) pumping means, driven by a liquid, for pumping at least a portion of the liquefied gas from the storage tank through the heat exchanger; (d) a gas supply line, operatively connected to the heat exchanger, for directly transferring the vaporized gas from the heat exchanger to the consumer upon demand; and (e) a control system associated with the heat exchanger and configured to control a rate of heat supply to the liquefied gas so as to vaporize the liquefied gas.

According to further features in the described preferred embodiments, the vaporized gas is a superheated gas.

According to still further features in the described preferred embodiments, the vaporized gas produced in step (c) is supplied directly to the consumer.

According to still further features in the described preferred embodiments, the liquid for driving the pumping means is used for heating the liquefied gas in step (c).

According to still further features in the described preferred embodiments, the liquid is heated externally to the system of step (a).

According to still further features in the described preferred embodiments, the method further includes heating the line to prevent condensation of the vaporized gas.

According to still further features in the described preferred embodiments, the heat for heating the line is provided by the liquid from the pumping means.

According to still further features in the described preferred embodiments, the liquid includes water.

According to still further features in the described preferred embodiments, the liquid consists of water.

According to still further features in the described preferred embodiments, the method further includes the step of (e) controlling a flow of the liquid so as to reduce an amount of liquid-phase gas in the line.

According to still further features in the described preferred embodiments, the controlling includes reversing the flow of the heat-exchange liquid.

According to still further features in the described preferred embodiments, the controlling includes increasing a temperature of the heat-exchange liquid.

According to still further features in the described preferred embodiments, the control system is configured to control a rate of heat supply to the liquefied gas so as to superheat the liquefied gas.

According to still further features in the described preferred embodiments, the system is designed and configured such that the heat exchange liquid is used as the liquid for driving the pumping means.

According to still further features in the described preferred embodiments, the system further includes: (f) heating means for heating the gas supply line so as to prevent condensation of the vaporized gas.

According to still further features in the described preferred embodiments, the heating means includes a line of the liquid for driving the pumping means, and the gas supply line and the heat-exchange liquid line are configured in heat-exchange relation.

According to still further features in the described preferred embodiments, the pumping means includes a hydraulic motor, connected to the pumping means, and driven by the liquid.

According to still further features in the described preferred embodiments, the pumping means includes a pump selected from the group consisting of a vane pump, an impeller pump, and a gear pump.

According to still further features in the described preferred embodiments, the heat exchanger and the pumping means are solely mechanical, such that any electrical components are disposed remotely from the storage tank.

According to still further features in the described preferred embodiments, the line of the liquid for driving the pumping means is disposed in side-by-side heat-exchange relation with the gas supply line.

According to still further features in the described preferred embodiments, the line of the liquid for driving the pumping means is disposed in coaxial heat-exchange relation with the gas supply line.

According to still further features in the described preferred embodiments, the system further includes (f) an auxiliary heat exchanger, operatively connected to the gas supply line, and disposed in series and downstream with respect to the heat exchanger, for ensuring full vaporization of the liquefied gas.

According to still further features in the described preferred embodiments, the auxiliary heat exchanger is heated by the heat exchange liquid.

According to still further features in the described preferred embodiments, the control system is further designed and configured to change a flow direction of the heat exchange liquid.

According to still further features in the described preferred embodiments, the control system is further designed and configured to change a flow direction of the heat exchange liquid in response to an indication from at least one indicator, such that fully vaporized gas is delivered to the consumer.

According to still further features in the described preferred embodiments, the control system is designed and configured to increase a temperature of the heat exchange liquid in response to an indication from at least one indicator, such that fully vaporized gas is delivered to the consumer.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
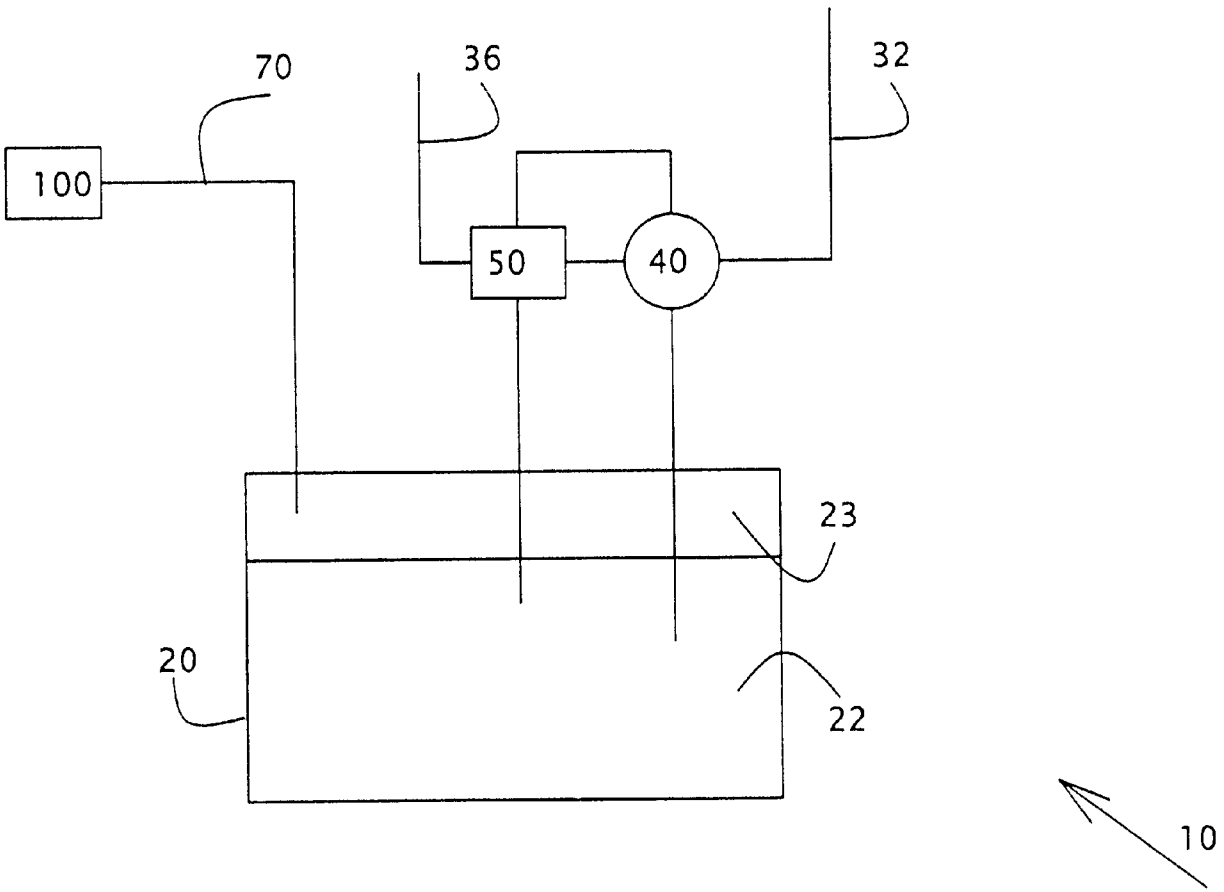
FIG. 1 is a block diagram illustrating a system for supplying vaporized gas according to the parent application, U.S. patent application Ser. No. 09/674,700.

The principles and operation of the system in the invention according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawing. The invention is capable of other embodiments or of being practiced or carried out in various ways. Also, it is to be understood that the phraseology and terminology employed herein is for the purpose of description and should not be regarded as limiting.

As used herein in the specification and in the claims section that follows, the term "liquid" refers to a non-explosive and, preferably, a non-inflammable liquid.

Referring now to the drawings, FIG. 1 is a block diagram illustrating a vaporization system 10 for vaporizing gas according to my parent application, U.S. patent application Ser. No. 09/674,700. A storage tank 20 contains gas, such as propane or butane, in liquefied form, in a lower region 22. Upper region 23, which is in fluid contact with lower region 22, contains gas in vapor form. Liquefied gas from lower region 22 is circulated, preferably by a water-driven turbine pump 40, through a heat exchanger 50. The liquefied gas is heated in heat exchanger 50, the heating being controlled such that the liquefied gas is returned in liquid form to storage tank 20. The sensible heat of the heated liquefied gas provides all of the requisite heat for vaporizing the gas, or at least a substantial portion thereof. The vaporized gas, produced in storage tank 20, is delivered to a consumer 100, according to demand, via a separate vapor line 70 connected to storage tank 20.

Heat exchanger 50 is a surface heat exchanger typically using water as the heat exchange liquid. The water, which is heated and pressurized externally to vaporization system 10, is introduced to heat exchanger 50 via line 36. The water exiting heat exchanger 50 can also serve to drive water-driven turbine pump 40, before leaving system 10 via line 32.

Although, in many respects, the above-described system is advantageous relative to the art known heretofore, there exist several distinct disadvantages, including:

1) the storage tank operates under equilibrium or near-equilibrium conditions, such that the vapor produced is substantially saturated vapor. Consequently, any cooling that occurs in the supply line results in condensation of a portion of the vaporized gas, a known problem in the art;
2) the entire system, including the storage tank and lines, is pressurized according to the demand pressure. In high-pressure gas delivery applications, this means that the entire system must operate under high pressure, a safety issue that preferably should be avoided.

By sharp contrast, the inventive system and method produce superheated gas. Moreover, the storage tank can operate at low/ambient pressure, as desired, even when pressure vaporized gas is demanded by the consumer.

Figure 2:
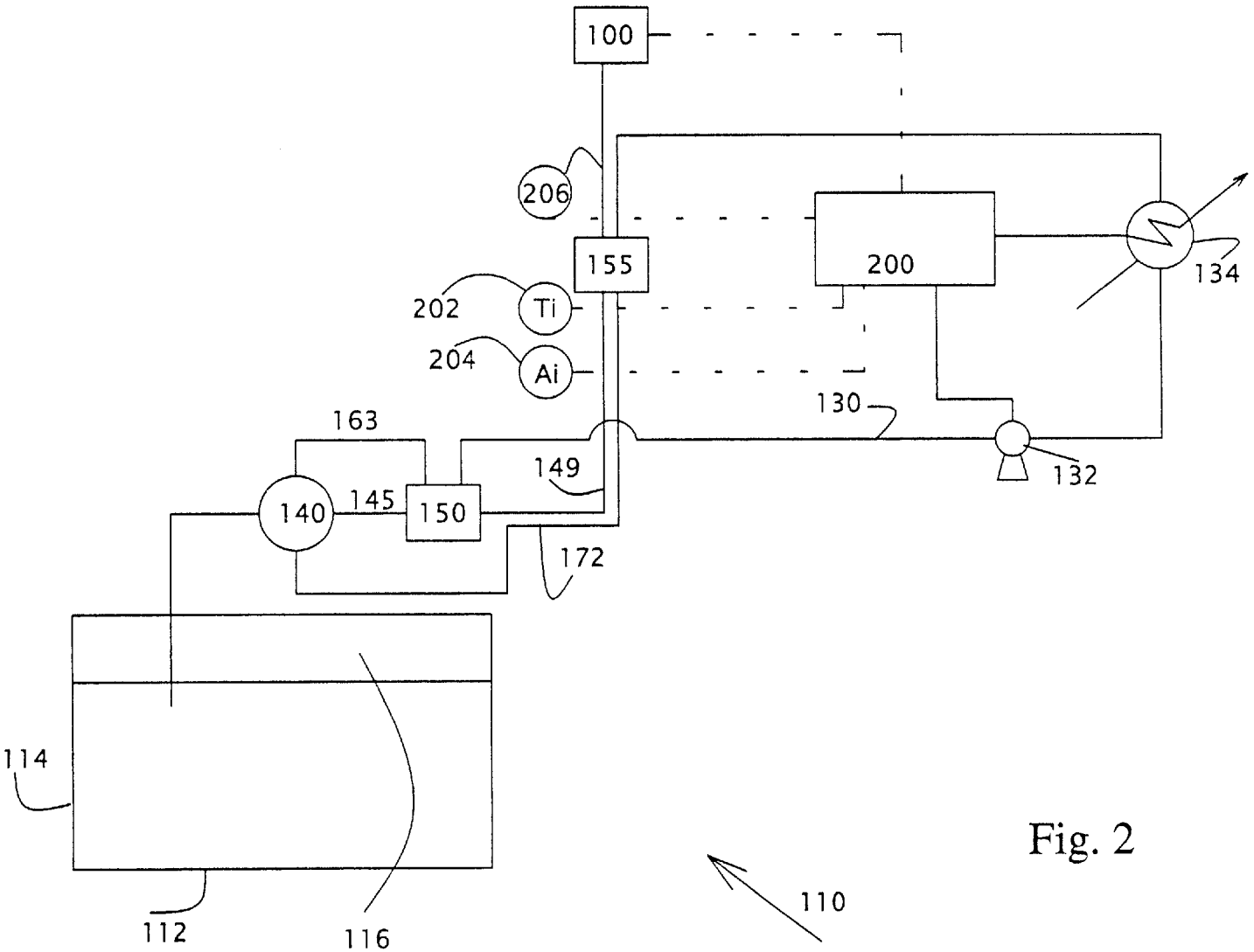
FIG. 2 is a block diagram illustrating one embodiment of a system for supplying vaporized gas according to the present invention.

FIG. 2 is a block diagram illustrating a system for supplying vaporized gas, according to the present invention. System 110 includes a storage tank 112 containing gas, such as propane or butane, in liquefied form within a lower region 114 and in a vapor form within an upper region 116. Liquefied gas from lower region 114 is pumped, preferably by a water-driven turbine pump 140, via line 145, through a heat exchanger 150. The heating in heat exchanger 150 is controlled so as to completely vaporize and, preferably, to superheat the gas. The superheated gas exits heat exchanger 150 through line 149, for delivery to a consumer 100, according to demand.

Heat exchanger 150 is a surface heat exchanger that typically uses water as the heat exchange liquid. The water, which is heated and pressurized externally to vaporization system 110, is introduced to heat exchanger 150 via line 130. The water exiting heat exchanger 150 via line 163 can also serve to drive water-driven turbine pump 140, before leaving system 110 via line 172.

Pump 140 is driven via a mechanical linkage by a hydraulic motor or turbine, which recover mechanical power from the water flowing through line 163. Pump 140 may be of various types known to those skilled in the art, including but not limited to vane pumps, impeller pumps, and gear pumps.

Although in the description, the water pumped by pump 132 is introduced to heat exchanger 150 prior to water-driven turbine pump 140, it is possible to pass the water through pump 140 before introducing the water to heat exchanger 150.

The vaporized gas exits heat exchanger 150 through line 149. The vaporized gas discharged from heat exchanger 150 is superheated so as to substantially prevent condensation of the gas en route to consumer 100. Preferably, line 149 is insulated. Optionally, line 149 is heated to further inhibit condensate formation in the vaporized gas being delivered to consumer 100.

In a presently-preferred embodiment, line 172, containing hot, spent water, is disposed in heat-exchange relation with line 149 (e.g., side by side piping, coaxial piping, etc.), such that heat is transferred to line 149 and condensation is prevented. Consequently, inventive system 110 does not require additional equipment such as condensate traps or separators, and condensate return lines. Moreover, a single hot water supply, delivered by pump 132, serves three functions: powering of water-driven turbine pump 140, supplying heat to heat exchanger 150, and heating line 149, which delivers vaporized gas to consumer 100. In addition to eliminating or at least drastically reducing the presence of liquid-phase gas in the gas delivered to the consumer, this design and configuration allow all electrical components in system 110 to be set at a distance from high-pressure, gas-containing lines and equipment.

It must be emphasized that various designs and configurations for achieving the requisite heat-exchange relation will be apparent to those skilled in the art.

It is known that various mechanical and control-related failures, as well as reduced consumer demand, can cause liquid-phase liquefied gas to be introduced to or to be condensed in consumer delivery line 149. Liquid-phase liquefied gas in the vaporized gas is a major problem for many consumers, and is also associated with various safety problems. Consequently, such a process scheme generally requires the addition of vapor/liquid separation equipment for providing the consumer with solely vaporized gas. In a preferred embodiment, shown in FIG. 2, system 110 includes an auxiliary heat exchanger 155, the main purpose of which is to further improve system safety and reliability, as will be explained hereinbelow. Auxiliary heat exchanger 155 is disposed in series and downstream with respect to heat exchanger 150, towards consumer 100. Auxiliary heat exchanger 155 is preferably heated by a hot water supply delivered by pump 132.

In the event that liquid-phase liquefied gas accumulates in consumer delivery line 149 between heat exchanger 150 and auxiliary heat exchanger 155, the liquid-phase gas is evaporated in auxiliary heat exchanger 155 using the enthalpy supplied by the hot water supply (delivered by pump 132).

Preferably, the design and sizing of heat exchanger 150 and the control of system 110 are such that heat exchanger 150 vaporizes all of the gas feed during normal working conditions. Hence, auxiliary heat exchanger 155 transfers a relatively small portion of heat to the gas that is being heated for supply to the consumer. During severe weather conditions, and more importantly, in the event of a malfunction in heat exchanger 150 (e.g., a sticking float control that allows liquid-phase liquefied gas to enter and pass through heat exchanger 150 to consumer delivery line 149), auxiliary heat exchanger 155, which is disposed on-line and is in a hot, working state, automatically delivers the requisite heat for vaporizing and superheating any and all liquid-phase liquefied gas passing through heat exchanger 150 and/or condensing in line 149 between heat exchangers 150, 155.

The control of system 110 is by no means trivial. The design criteria include:

Delivery of exclusively vapor-phase gas to the consumer

Substantially 100% reliability

Minimization of safety risks associated with electrically-powered components in the vicinity of a system containing inflammable or explosive gases Quick response to consumer demand Ability to cope with periods in which there is no consumer demand In one embodiment, controller 200 receives measured data from temperature indicator 202 and pressure indicator 204, both of which are preferably disposed within line 149. Controller 200 is preferably pre-programmed with saturation curve data, i.e., saturation temperature as a function of pressure. The required degree of superheating (e.g., a predetermined number of ° C. above the saturation temperature) may be input as a set-point into controller 200. Alternatively or additionally, a condensate indicator 206 in line 149 enables feedback control, in which the degree of superheating is set and/or corrected based on the presence of condensate in line 149. This may be important if exact T-P saturation curves are not available for the gas, or as a backup to temperature indicator 202 and pressure indicator 204. Controller 200 preferably receives input on demand from consumer 100. Controller 200 is preferably designed to control at least one of the following: temperature of hot water line 130, flowrate of hot water line 130, and total heat supplied to heat exchanger 134. The control of the temperature of hot water line 130 is particularly important in that it enables partial decoupling of the recirculation rate of the heat exchange liquid from the rate of liquefied gas introduced to pump 140.

In another preferred embodiment, pump 132 and hot water line 130 are designed and configured so as to allow a reversal of the hot water flow. Controller 200, upon receiving input from at least one of the indicators, or a manual command from a system operator, reverses the direction of the flow in hot water line 130, such that the hot water heats the gas in counter-current fashion. This enables auxiliary heat exchanger 155 to deliver additional heat to the gas. In the event that a large quantity of liquid-phase gas is present in line 149 after heat exchanger 150, the counter-current flow of hot water, coupled with a larger $\Delta T$ across the heat exchanger and an improved heat transfer coefficient, combine to significantly increase the amount of liquid-phase gas that is vaporized and superheated in auxiliary heat exchanger 155. The upper bound for the temperature of the gas delivered to the consumer is easily controlled by limiting the temperature of the hot water discharged from heat exchanger 134.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, no citation or identification of any reference in this application shall be construed as an admission that such reference is available as prior art to the present invention.

What is claimed is:

1. A method for supplying vaporized gas to a consumer, the method comprising the steps of:

(a) providing a system including:

(i) a storage tank for storing liquefied gas, said tank having a lower liquid region and a vapor region thereover;

(ii) a heat exchanger external to said storage tank;

(iii) pumping means driven by a liquid;

(iv) a line for directly transferring the vaporized gas from said heat exchanger to the consumer;

(b) pumping at least a portion of said liquefied gas from said lower region to said heat exchanger using said pumping means;

(c) heating said liquefied gas in said heat exchanger to produce the vaporized gas; and (d) supplying the vaporized gas directly to the consumer, according to consumer demand.

2. The method of claim 1, wherein the vaporized gas is a superheated gas.

3. The method of claim 1, wherein all of the vaporized gas produced in step (c) is supplied directly to the consumer.

4. The method of claim 1, wherein said liquid for driving said pumping means is used for heating said liquefied gas in step (c).

5. The method of claim 4, wherein said liquid is heated externally to said system in step (a).

6. The method of claim 1, further including heating said line to prevent condensation of said vaporized gas.

7. The method of claim 6, wherein heat for said heating of said line is provided by said liquid from said pumping means.

8. The method of claim 1, wherein said liquid includes water.

9. The method of claim 4, further comprising the step of (e) controlling a flow of said liquid so as to reduce an amount of liquid-phase gas in said line.

10. The method of claim 9, wherein said controlling includes reversing said flow of said liquid.

11. The method of claim 9, wherein said controlling includes increasing a temperature of said liquid.

12. A system for supplying vaporized gas to a consumer, the system comprising:

(a) a storage tank for storing liquefied gas, said tank having a lower liquid region and a vapor region thereover;

(b) a heat exchanger external to and fluidly communicating with said storage tank, within which heat exchanger, a heat exchange liquid and said liquefied gas come into indirect heat-exchange relation;

(c) pumping means, driven by a liquid, for pumping at least a portion of said liquefied gas from said storage tank through said heat exchanger;

(d) a gas supply line, operatively connected to said heat exchanger, for directly transferring the vaporized gas from said heat exchanger to the consumer upon demand; and (e) a control system associated with said heat exchanger and configured to control a rate of heat supply to said liquefied gas so as to vaporize the liquefied gas.

13. The system of claim 12, wherein said control system is configured to control a rate of heat supply to said liquefied gas so as to completely vaporize the liquefied gas.

14. The system of claim 12, wherein said control system is configured to control a rate of heat supply to said liquefied gas so as to superheat the liquefied gas.

15. The system of claim 12, designed and configured such that said heat exchange liquid is used as said liquid for driving said pumping means.

16. The system of claim 12, further comprising:

(f) heating means for heating said gas supply line so as to prevent condensation of said vaporized gas.

17. The system of claim 16, wherein said heating means includes a line of said liquid for driving said pumping means, and wherein said gas supply line and said line are configured in heat-exchange relation.

18. The system of claim 12, wherein said pumping means includes: a hydraulic motor, connected to said pumping means, and driven by said liquid.

19. The apparatus of claim 18, wherein said pumping means includes a pump selected from the group consisting of a vane pump, an impeller pump, and a gear pump.

20. The system of claim 12, wherein said heat exchanger and said pumping means are solely mechanical, such that any electrical components are disposed remotely from said storage tank.

21. The system of claim 12, wherein said liquid for driving said pumping means consists of water.

22. The system of claim 17, wherein said line of said liquid for driving said pumping means is disposed in side-by-side heat-exchange relation with said gas supply line.

23. The system of claim 17, wherein said line of said liquid for driving said pumping means is disposed in coaxial heat-exchange relation with said gas supply line.

24. The system of claim 12, further comprising:

(f) an auxiliary heat exchanger, operatively connected to said gas supply line, and disposed in series and downstream with respect to said heat exchanger, for ensuring full vaporization of said liquefied gas.

25. The system of claim 24, wherein said auxiliary heat exchanger is heated by said heat exchange liquid.

26. The system of claim 24, wherein said control system is further designed and configured to change a flow direction of said heat exchange liquid.

27. The system of claim 24, wherein said control system is further designed and configured to change a flow direction of said heat exchange liquid in response to an indication from at least one indicator, such that fully vaporized gas is delivered to the consumer.

28. The system of claim 24, wherein said control system is designed and configured to increase a temperature of said heat exchange liquid in response to an indication from at least one indicator, such that fully vaporized gas is delivered to the consumer.

* * * * *